US005398048A

United States Patent [19]

O'Mahony

[11] Patent Number: 5,398,048

[45] Date of Patent: Mar. 14, 1995

[54] INTEGRATED-CIRCUIT CHIP AND SYSTEM FOR DEVELOPING TIMING REFERENCE SIGNALS FOR USE IN HIGH-RESOLUTION CRT DISPLAY EQUIPMENT

[75] Inventor: Denis O'Mahony, Drimoleague, Ireland

[73] Assignee: Analog Devices, Inc., Norwood, Mass.

[21] Appl. No.: 79,090

[22] Filed: Jun. 17, 1993

Related U.S. Application Data

[63] Continuation of Ser. No. 665,309, Mar. 6, 1991, abandoned.

[51] Int. Cl.[6] ..... G09G 1/06

[52] U.S. Cl. ..... 345/212; 345/185

[58] Field of Search ..... 340/709, 799, 798, 701, 340/703, 747; 345/112, 133, 205, 212, 213, 185, 186; 395/150, 115

[56] References Cited

U.S. PATENT DOCUMENTS 4,244,021 1/1981 Chiles, III ..... 73/379

4,894,653 1/1990 Frankenback ..... 340/703

OTHER PUBLICATIONS

"IMS G300 Colour Video Controller" in MOS, Preliminary Data pp. 73–75, 85, 93–95.

*Primary Examiner*—Ulysses Weldon

*Assistant Examiner*—Doon Chow

*Attorney, Agent, or Firm*—Parmelee, Bollinger & Bramblett

[57] ABSTRACT

CRT control apparatus for use in high-resolution graphic display equipment of the type including a graphics processor and a frame buffer having storage banks for storing digital signals representing the color intensities of red, green and blue colors of pixels to be presented on the CRT screen. The apparatus includes an MOS integrated-circuit (IC) chip which serves as the master timing control for the entire CRT sub-system, including timing of the read-out of pixel signals from the frame buffer, loading of the pixel signals into latches on the MOS chip, and multiplexing of the signals stored in the latches. Digital signals representing the color intensities are directed to corresponding DACs which generate the analog intensity color signals for the electron guns of the CRT.

26 Claims, 8 Drawing Sheets

INTEGRATED-CIRCUIT CHIP AND SYSTEM FOR DEVELOPING TIMING REFERENCE SIGNALS FOR USE IN HIGH-RESOLUTION CRT DISPLAY EQUIPMENT

This application is a continuation of application Ser. No. 07/665,309 as originally filed on Mar. 6, 1991 is now abandoned.

BACKGROUND OF THE INVENTION

1. Field of the Invention

This invention relates to high-resolution display apparatus utilizing a cathode ray tube (CRT) for presenting color graphics. More particularly, this invention relates to such apparatus wherein the CRT control data is stored in digital format and is converted to analog format for controlling the CRT electron beam guns.

2. Description of the Prior Art

Systems for producing high-resolution displays on CRTs, such as for computer graphics displays, commonly develop the picture control data in digital format. Such data is stored in a so-called frame buffer comprising a large number of random-access-memory devices (Video RAMs) arranged as storage banks for the CRT pixel signals. The frame buffer conventionally is controlled by a graphics processor which directs the transfer of data to and from the frame buffer in properly synchronized fashion. The digital data read-out from the frame buffer is directed to a set of digital-to-analog converters which produce corresponding analog signals for respective color guns of the CRT, thereby to control the intensity of each color (red, green, blue) for each pixel of the CRT display. For these various data transfer and other operations, precisely-controlled timing signals are required.

Prior art system arrangements and integrated-circuit devices used therewith have been ill-suited to obtain optimum operation, and particularly have been unable to provide flexibility for adapting to different operating modes as desired by manufacturers of different types of graphic display apparatus. For example, the graphics processor and frame buffer commonly have been interconnected through specialized logic circuits which are not readily alterable to meet different operating conditions. Thus each system must in effect be custom crafted for its particular application. In addition, prior art systems typically have required the use of fast TTL logic circuitry (dividers, flip/flops and gates) which can create problems through generation of electromagnetic radiation.

SUMMARY OF THE INVENTION

In a preferred embodiment of the invention, to be described in detail hereinbelow, there is provided a CRT control system for use in high-resolution CRT display equipment of the type comprising a frame buffer having a random access memory means for storing digital signals representing the colors of corresponding pixels on the CRT. The digital data stored in the frame buffer is continuously updated by a so-called graphics processor, and is used to periodically refresh the CRT screen, e.g., at a 60 Hz rate. The frame buffer includes a serial read-out port for transferring in serial fashion successive parallel-formatted digital control signals from the buffer storage banks to digital-to-analog converters which create properly synchronized analog control signals for controlling the intensities of the electron beams from the color guns of the CRT.

In accordance with the invention, a single MOS integrated-circuit (IC) chip is provided for processing the digital color signals and for generating timing signals to establish the necessary synchronization for the delivery of the analog control signals to the CRT. This chip provides an interface which in effect is a master control center, and functions directly with the graphics processor, the frame buffer, and the CRT sub-system, without the need for additional logic circuitry.

The chip is coupled to a single oscillator crystal which delivers directly to the chip a high-frequency clock signal (e.g., 100 MHz or greater). From that basic timing signal the chip develops a number of other timing signals to be directed to the other system components in such a way as to assure proper system functioning, and yet flexibly provide for operation with a variety of operating modes and system configurations. With divided-down timing signals originating at the chip, the other system components do not have to provide for operation at the highest frequencies. And with all internal timing from a single MOS chip, data transfers can be made more quickly (without set-up time), and the CRT control system apparatus can be operated at or near maximum speeds. The single MOS chip moreover provides for programmable control of timing and frequency of selected signals so as to accommodate use of the chip in different types of CRT graphics display equipment.

Other objects, aspects and advantages of the invention will in part be pointed out in, and in part apparent from, the following description of a preferred embodiment of the invention, considered together with the accompanying drawings.

DESCRIPTION OF A PREFERRED EMBODIMENT

Figure 1:
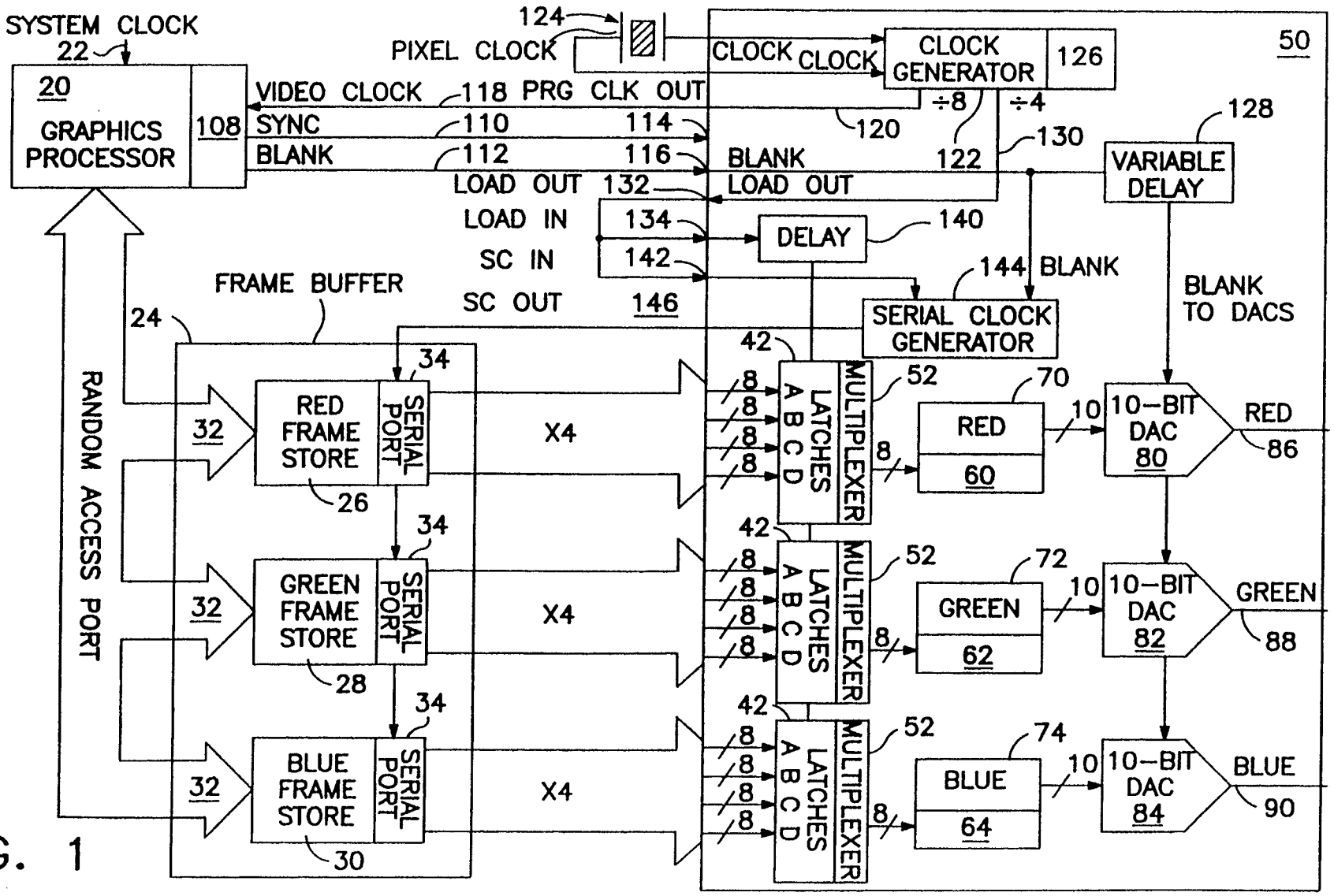
FIG. 1 is a block diagram showing one system arrangement in accordance with the invention.

Referring now to the upper left-hand corner of the block diagram of FIG. 1, there is shown a graphics processor 20 of known type for use in a CRT control system for high-resolution color graphics display equipment. This graphics processor comprises conventional digital processing apparatus for performing many of the required system functions. These functions are for the most part synchronized by timing control signals supplied by a system clock indicated at 22 (normally having a frequency between 5 and 40 MHz). One of the tasks performed by the graphics processor is that of directing the flow of digital color-intensity signals to a so-called frame buffer 24 of conventional construction.

The frame buffer 24 shown in FIG. 1 includes red, green and blue frame stores 26, 28 and 30 which contain all of the color signal data for display of one complete frame on the associated CRT (not shown). These color frame stores are arranged as a large number of storage banks storing digital color signals (e.g., 8-bits each) for all of the 3-color "pixels" to be painted on the CRT. The number of pixels may of course vary for different CRTs, but by way of example the display may have 786,432 pixels, arranged as 1024 pixels in each horizontal line, and 768 lines in each frame.

Color signal data from the graphics processor 20 updates the frame buffer 24 essentially continuously so that the buffer always contains current signal information defining all of the color pixels of a complete frame of the CRT. The system illustrated in FIG. 1 is a "true color" system, with separate channels for red, green and blue color control signals, and wherein the stored signal data directly identifies by corresponding codes (8-bit signals, in the disclosed embodiment) the intensity of each color of each pixel. Features of the invention are however applicable to so-called color indexing systems as well, wherein the stored signal data in the frame buffer identifies an index or pointer to the color intensity data rather than storing the actual color intensity data itself.

Figure 2:
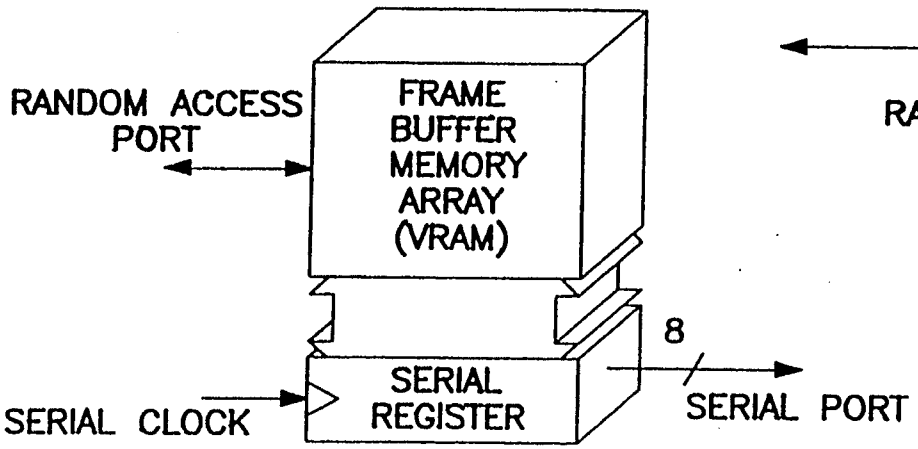
FIG. 2 PRIOR ART
FIG. 2 is a pictorial presentation illustrating aspects of a frame buffer memory.

The frame buffer 24 typically is constructed using Video Random Access Memories (VRAMs). Referring also to FIG. 2, modern frame buffer memory arrays have two ports: a random access port and a serial port. The random access ports are shown in FIG. 1 at 32, one for each of the color frame stores 26, 28, 30. The random access ports are used by the graphics processor 20 to update the digital pixel data stored in the frame buffer.

FIG. 1 also shows separate serial ports 34 for each of the color frame stores 26, 28, 30. The serial ports provide a high-speed channel which is used to read out the digital pixel signals of the frame buffer for refreshing the display on the CRT, e.g., at a 60 Hz rate. These serial ports include shift registers controlled in unison by a serial clock signal (see FIG. 2). An entire scan line (i.e., representing one horizontal line of the CRT) can be periodically "dumped" from frame buffer memory into these shift registers for subsequent read-out at high speed. This arrangement gives the graphics processor 20 full access to the frame buffer for updating the buffer memory through the random access ports while the shift register contents are being continuously clocked out serially to the CRT.

Figure 3:
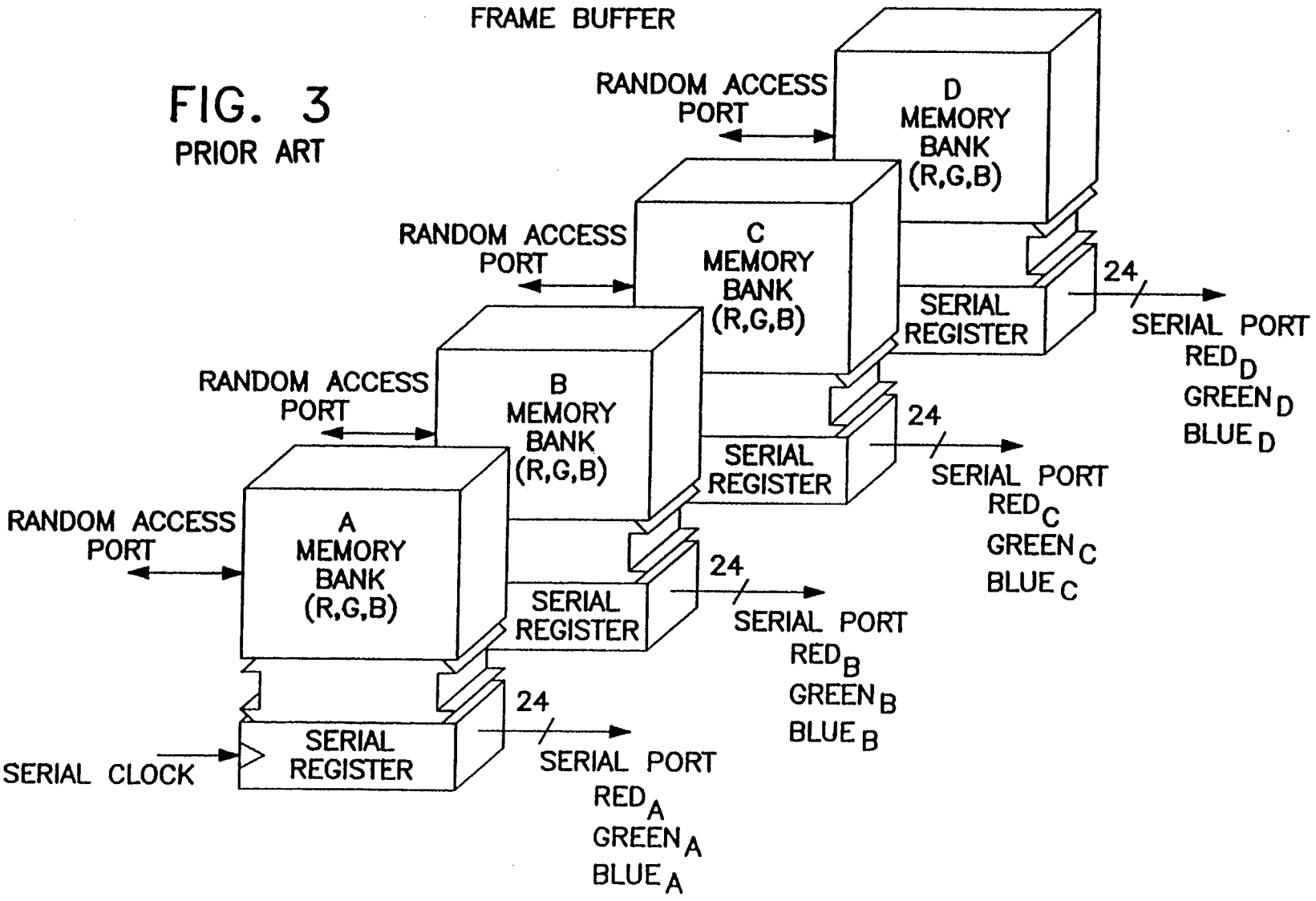
FIG. 3 PRIOR ART
FIG. 3 illustrates pictorially a number of frame buffer memory banks.

The CRT control system advantageously makes use of multiplexing to obtain maximum benefit from the high-speed capability of the CRT display control equipment. To accommodate such multiplexing, the frame stores 26, 28, 30 are divided into a series of storage banks for the color data signals for respective successive points (pixels) along the horizontal lines of the CRT display. These stored signals, in composite, define all of the color pixels on the CRT screen. FIG. 3 illustrates an arrangement wherein the stored data is divided into four memory banks A, B, C, D, with each bank containing all of the pixel signal data (red, green, blue) for one-fourth of the pixels to be presented on the CRT. Bank A, for example, might include all of the data for pixel #1 (starting at the upper left-hand corner of the screen), pixel #5 (i.e., displaced by four pixels from #1), pixel #9, etc., while Bank B would carry the data for pixels #2, 6, 10, and so on. As indicated, the serial ports of these memory banks clock out this signal data in the form of 24-bit parallel-formatted signals, 8 bits for each color.

The total amount of pixel storage needed in the frame buffer 24 depends upon the resolution of the CRT. For example, for the fairly common arrangement of 1024 pixels per horizontal line, and 768 lines per frame, storage for a total of 786,432 24-bit pixels would be needed to store all of the 3-color pixel signals for the CRT.

The internal structure of the storage banks shown in FIG. 3 can be organized in various configurations to accommodate multiplexing. For example, referring to FIG. 4, the signals for any one color in any one bank can be stored in an assembly of so-called bit-planes, each providing a storage section which (for the embodiment disclosed) is 256 bits wide by 768 bits down. There are eight bit-planes per assembly, thus providing an 8-bit parallel-formatted output signal for each color of each pixel of the storage bank. Three such assemblies of bit-planes are needed for all three colors for each of the four banks.

Figure 4:
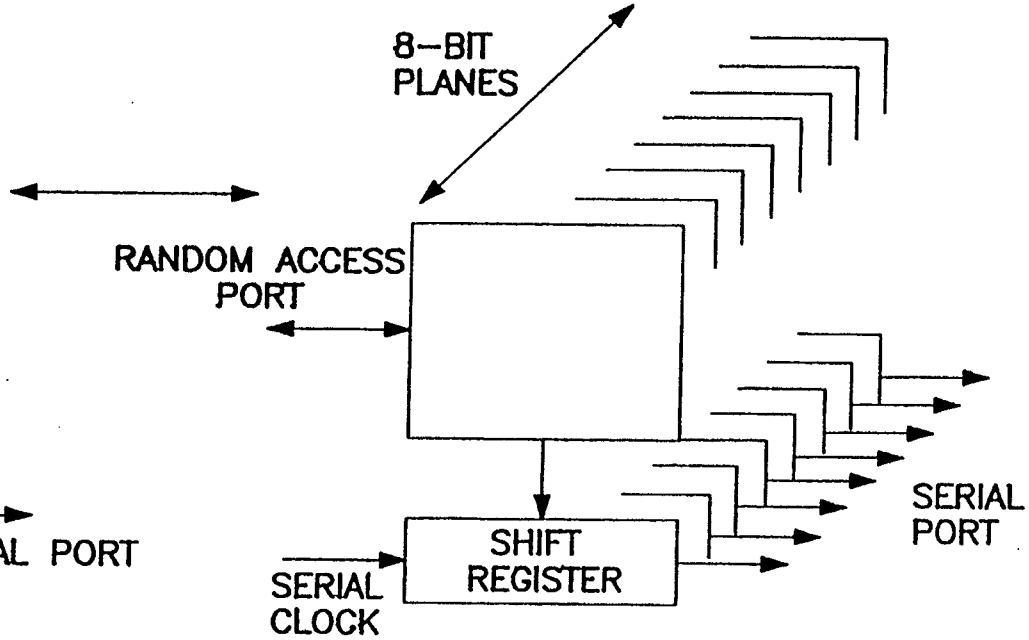
FIG. 4 PRIOR ART
FIG. 4 illustrates pictorially a set of bit-plane storage elements.

As shown in FIG. 4, each such bit-plane has its own serial read-out port (note that FIG. 1 shows these serial ports more simply as a single port for each color), so that 24-bit parallel-formatted signals can be read-out serially. By clocking out the serial ports for all four banks together, 96 bits will be read out, representing the complete pixel data for four successive pixels along the CRT line, e.g., pixel nos. 1, 2, 3 and 4.

Figure 5:
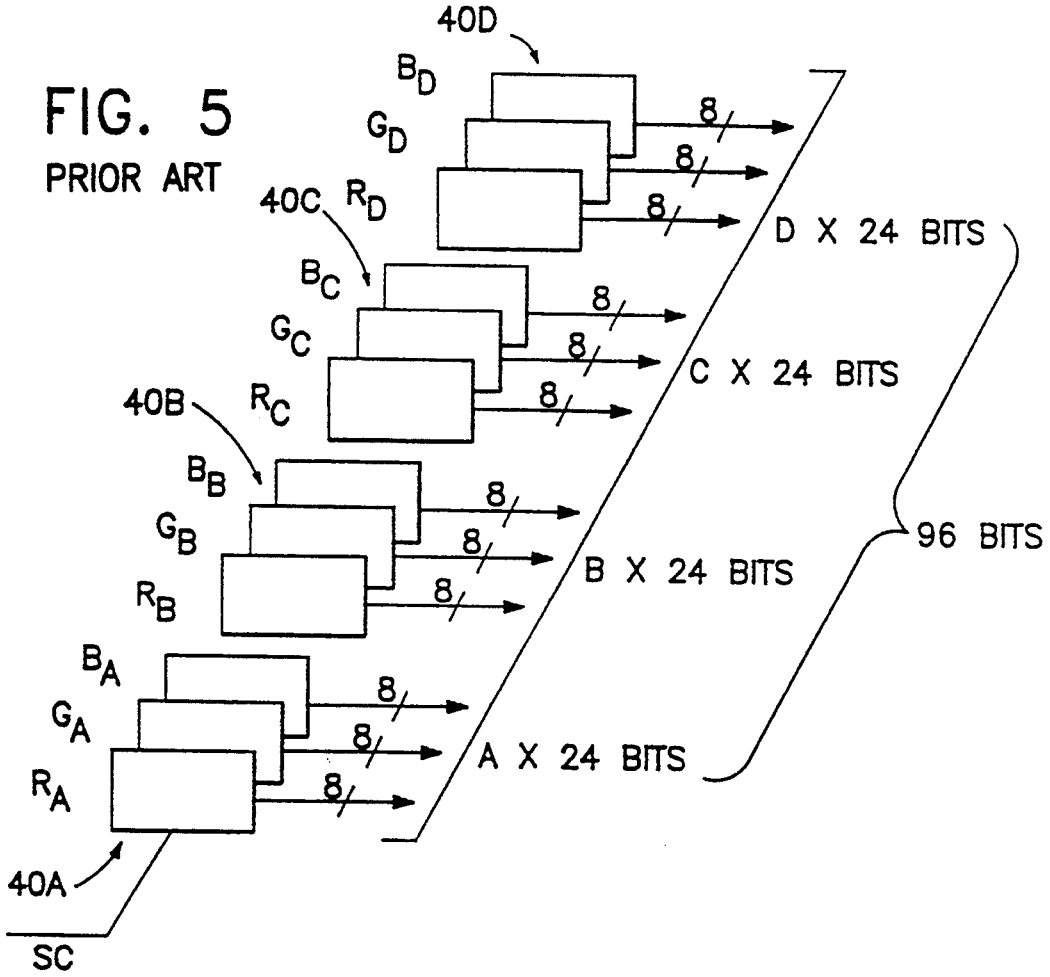
FIG. 5 PRIOR ART
FIG. 5 illustrates pictorially the serial port read-out arrangement for a set of four memory banks.

Referring now also to FIG. 5, the frame buffer read-out function for 4:1 multiplexing is shown pictorially for a group of four successive 3-color pixels identified with the subscripts A, B, C, D. The pictured arrangement comprises four sets of storage sections 40A–40D each including the signal data for all three colors ($R_A$, $G_A$, $B_A$; $R_B$, $G_B$, $B_B$; etc.) for a corresponding pixel of the CRT display. For a 4:1 multiplexing system, read-out of all four storage sections 40A–40D will be effected simultaneously to transfer a total of 96 bits at a time in parallel format.

Figure 6:
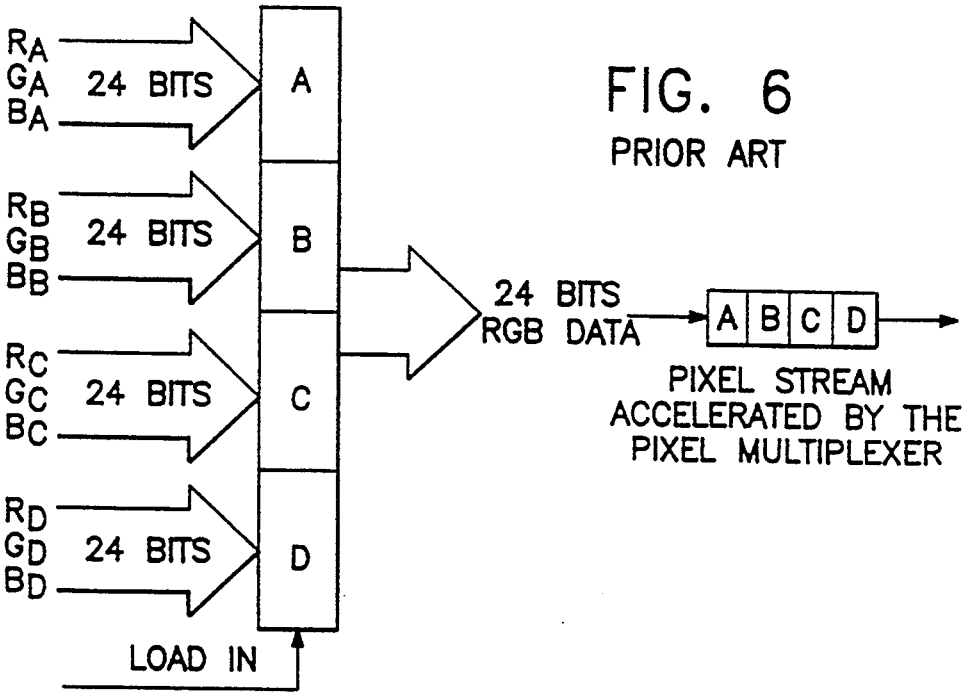
FIG. 6 PRIOR ART
FIG. 6 is a diagram showing the parallel-formatted signals from the frame buffer being loaded into a set of latches.

Referring now to FIG. 6, the 24-bit data signals clocked out from the frame buffer serial ports are loaded into corresponding latches 42 (A, B, C, D). These latches are scanned by a pixel multiplexer to produce a serial stream of 24-bit "packets" of RGB color signals (A, B, C, D). For example, the system might be arranged so that these 24-bit packets are loaded simultaneously into the latches 42 at a 25 MHz clock rate (the frame buffer clock rate), and thereafter scanned out by the associated multiplexer at an accelerated 100 MHz clock rate, so as to be synchronized with the CRT Video clock.

The latches 42 form part of an MOS integrated circuit (IC) chip generally indicated at 50 in FIG. 1. They are shown arranged in FIG. 1 as separate storage sections for the three colors, with all of the red 8-bit signals grouped together for the successive pixels A, B, C, D, and so on for the other colors. The actual physical arrangement of the latches is however unaffected, and the grouping shown in FIG. 1 is only for convenience of presentation.

FIG. 1 also shows a multiplexer 52 (or "accelerator") for each of the three sets of latches 42. These multiplexers scan the stored data in sequence (A, B, C, D) so as to produce a corresponding serial stream of 8-bit color signals.

These 8-bit color signals are distributed to corresponding red, green and blue color channels within the IC chip 50. Each 8-bit color signal is loaded into a receiving port 60, 62, 64 forming part of a respective digital-signal-transformation device generally indicated at 70, 72, 74. This device includes memory means for storing a number of 10-bit pre-set data signals in addressable storage segments. Each 8-bit color signal, when loaded into a receiving port, is used as an addressing signal to identify the location of a corresponding 10-bit-wide storage segment in the corresponding device 70–74.

Each such addressable storage segment contains a pre-stored 10-bit data signal corresponding to the 8-bit color signal loaded into the receiving port. That is, each device 70, 72, 74 functions in the manner of a look-up table, producing a 10-bit parallel-formatted data signal corresponding to the applied 8-bit color signal. The 10-bit signal incorporates the color-intensity information of the original 8-bit color signal, and also includes additional information related to the identified color signal. For example, this additional information could if desired provide a so-called gamma correction for effecting linearization of the human eye's perception of the particular color gun intensity identified by the original 8-bit signal. Using the original 8-bit signal for addressing purposes makes it possible to access any of 256 pre-stored 10-bit data signals.

The 10-bit data signals from the signal-transformation devices 70, 72 and 74 are directed to corresponding 10-bit digital-to-analog converters (DACs) 80, 82, 84. These DACs convert each 10-bit signal to a corresponding analog intensity control signal delivered by respective lines 86, 88, 90 to the three color electron guns of the CRT (not shown).

The application of these analog color intensity signals to the control electrodes of the respective electron guns is synchronized with the movement of the beam raster across the face of the CRT. The timing of the analog signals and the synchronized sweeping of the electron beams across the CRT are illustrated in FIGS. 7 and 8.

Figure 7:
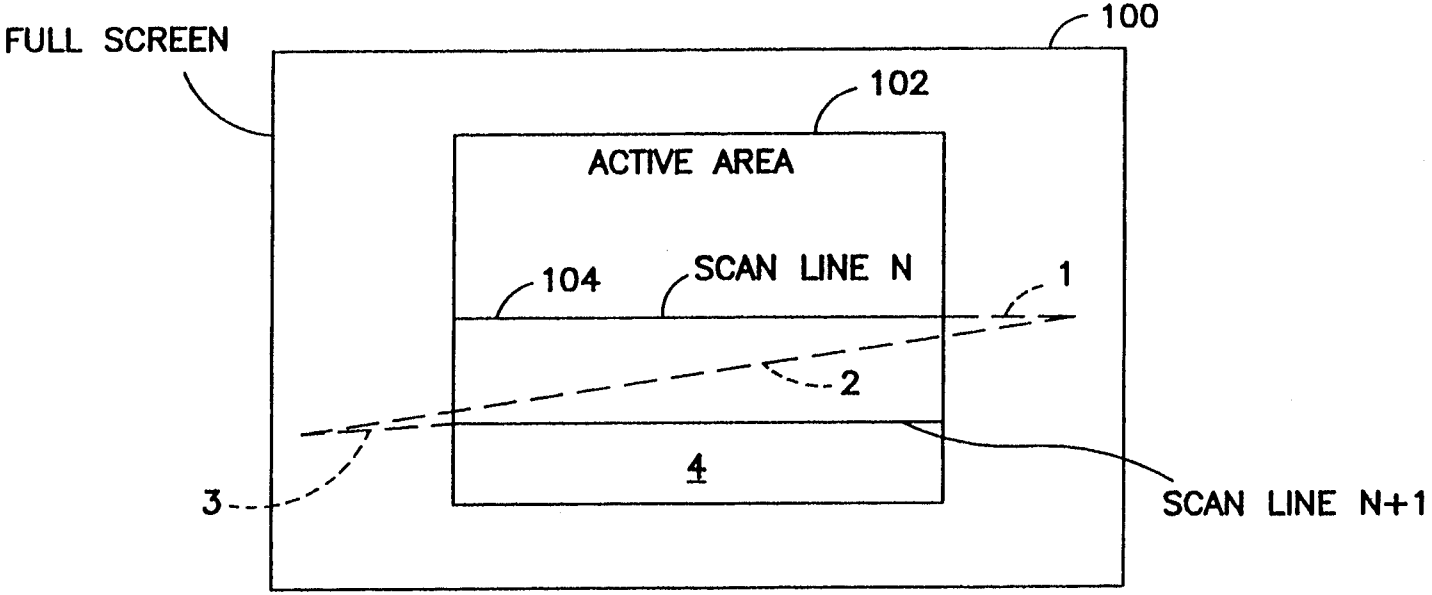
FIG. 7 shows the raster-scan operation of a CRT.
Figure 8:
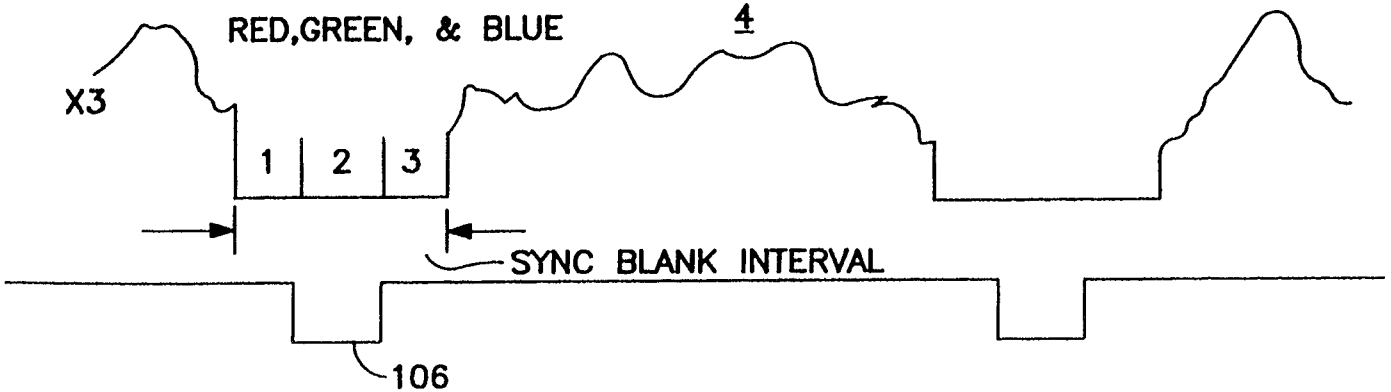
FIG. 8 is a graph illustrating the signal sequences for a raster-scan CRT.

FIG. 7 shows the front face of a CRT, with the full screen represented by the rectangle 100, and the available active area represented by the interior rectangle 102. As is well known, the face of the CRT is illuminated by raster-controlled sweeping of three electron beams (one for each color) across the face of the CRT, while the intensities of the beams are controlled so as to produce the desired color pixels at predetermined locations along the sweep line. FIG. 7 shows at 104 a typical horizontal sweep (for one color) identified as "scan line N". At the end of the active area, the intensity of the beam is cut ("blanked") so that no illumination is produced as the beam continues horizontally beyond the active area. This segment, identified as 1, is known as the "horizontal front porch".

In response to a horizontal Synch signal 106 (see FIG. 8), the beam is caused to fly back along the dotted line 2 to an initial position which is near the left-hand edge of the CRT face and slightly lower than the preceding sweep N. From this position, the beam will start back towards the right-hand side of the CRT for the next scan line N+1. The period of time required to reach the active area 102 from this start position is identified as 3, and is referred to as the back porch time; the beam intensity remains blanked during this segment.

Upon reaching the active area 102, the beam is unblanked, and the next scan line N+1 begins, identified as 4. At the end of this scan line, the retrace process repeats (unless N+1 was the last scan line of the frame). During the scan line time, the intensity of the electron beam is (as in the preceding scan line) controlled by the analog output of the corresponding DAC (80, 82, 84), as illustrated in FIG. 8 and also labelled 4. There will of course be three separate electron beam fluctuations, one for each color, as indicated on the drawing by X3.

At the end of the frame, a vertical Synch operation similar to horizontal Synch is carried out, except that in this case the electron beam is returned to its initial start position at the upper left-hand corner of the CRT face. As before, the beam is blanked during the flyback time. The blank interval includes a vertical front porch, a flyback period, and a vertical back porch prior to start of the next active frame. As with horizontal synchronizing, the vertical blanking occurs before the vertical Synch signal (i.e., at the start of the vertical front porch), and remains active after the vertical Synch signal is de-activated, until the beam again starts into the active area. The vertical retrace time is the sum of the vertical Synch and the front and back porch times. Vertical retrace times typically range from 600 to 1400 μsec.

The graphics processor 20 generates the Synch (both Horizontal and Vertical) and Blank signals for controlling the monitor's sweep circuitry, by means of conventional logic circuitry illustrated at 108 in FIG. 1. These signals are carried by lines 110 and 112, and are delivered to corresponding pins 114 and 116 of the IC chip 50. Generation of the Synch and Blank signals is based upon a Video Clock Signal 118 supplied to the logic circuitry 108 by another pin of the IC chip 50. This circuitry may comprise frequency dividers for producing the Synch and Blank signals at a frequency substantially less than that of the Video Clock frequency.

The Video Clock signal 118 is developed within the chip 50 at one output 120 of a clock generator 122. This output is identified as PRGCLKOUT (programmable clock out). In the disclosed embodiment, this clock generator 122 includes divide-down circuitry activated by complementary pixel clock signals from an external crystal oscillator source 124 (such clock signals sometimes being referred to as Dotclock). This oscillator typically will have a quite high frequency such as 100 MHz, 120 MHz, or higher. In the disclosed embodiment, the Video Clock signal is divided down by 8:1 from the pixel clock.

The amount of dividing-down may be set to any of a range of values, as by conventional programmable means indicated at 126, and forming part of the clock generator 122. The amount of division selected will be such as to provide a Video Clock rate lower than the maximum frequency at which the graphics processor 20 is capable of operating. The pixel clock signals are not synchronized with the system clock 22 for the graphics processor.

The Blank signals at pin 116 are directed to a variable (i.e., user controllable) time delay device 128 the output of which is an internal blanking signal connected to the DACs 80, 82, 84. This blanking signal in effect suppresses the analog outputs of the DACs when the CRT beams are not in the active area of the display, so that there will be no illumination of the CRT except during the times that pixels are to be painted on the face of the tube.

The clock generator 122 includes a second output 130, which in this embodiment is a clock signal divided-down by 4 from the pixel clock. This output is connected to a pin 132 of the IC chip 50, and the clock signal from that pin is referred to as "load out". This clock signal can be used in various ways, but in the disclosed embodiment it is connected to another pin 134 where it supplies the clock signal referred to as "load in". This load-in signal is passed through an adjustable time delay device 140 the output of which is delivered to the pixel latches 42, to synchronize the taking of the pixel signals from the serial ports 34. The load-in signal can for certain applications be supplied to the chip 50 by other components of the system, rather than from the load-out signal.

The load-out signal at pin 132 also is connected to a pin 142 for supplying a serial-clock-in (SCIN) signal to a serial clock generator 144. The output of this generator is referred to as SCOUT (serial clock out), and is connected to another pin 146 which in turn is connected to the frame buffer 24. The SCOUT signals are directed in the frame buffer to the serial ports 34 to synchronize the gating out of the pixel signals from those ports.

The serial clock output signals (SCOUT) essentially repeat the SCIN clock signals, but are gated by the Blank signal from the graphics processor 20. When the electron beams enter the active area of the CRT, the DACs 80–84 are unblanked, and the stream of pixel signals from the serial ports 34 are gated out to the pixel latches in correct timing relationship to paint the pixels on the face of the CRT.

Figure 9:
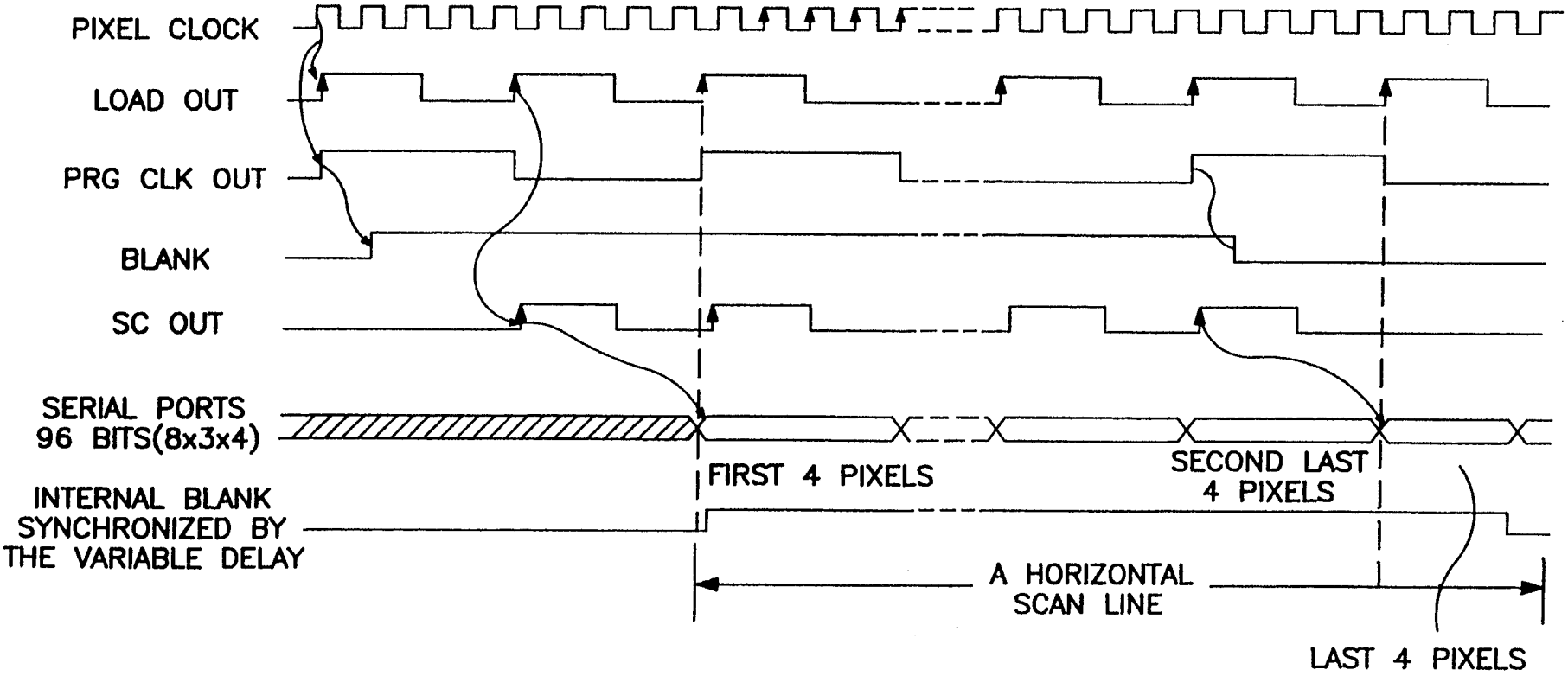
FIG. 9 is a timing diagram to aid in explaining the operation of the system of FIG. 1.

FIG. 9 is a timing diagram illustrating these relationships more precisely. The top line shows the basic pixel clock, and the next line is the load-out clock signal having a frequency one-fourth that of the pixel clock. The third line shows the PRGCLKOUT signal (programmable clock out), at a frequency one-eighth that of the pixel clock. All three of these clocks run continuously. The curved lines joining the rising edges of the clock pulses show the correspondence between the pulses, and indicate that there is some time lag between certain of the timing pulses.

The fourth line of FIG. 9 shows the timing of the Blank signal from the graphics processor 20. The start of this signal lags somewhat the initiating rising edge of the programmable clock out signal.

The fifth line of FIG. 9 shows that the SCOUT pulses begin when a rising edge of the load-out signal occurs after the Blank signal goes high. The Blank signal is an active low signal, so that when it goes high, it signals unblanking.

The rising edge of the first SCOUT pulse activates the delivery of the digital signals for the first 4 pixels in the CRT line (i.e., pixels previously identified as A, B, C, D). At the same time, an internal blanking signal goes high, to activate the DACs 80–84 so as to begin to paint the pixels on the CRT. The start of this internal blanking signal is delayed by the variable time delay device 128 (FIG. 1) to assure proper synchronism between the arrival of the digital data, the entry of the beams into the CRT active area, and the unblanking of the beams.

Figure 10:
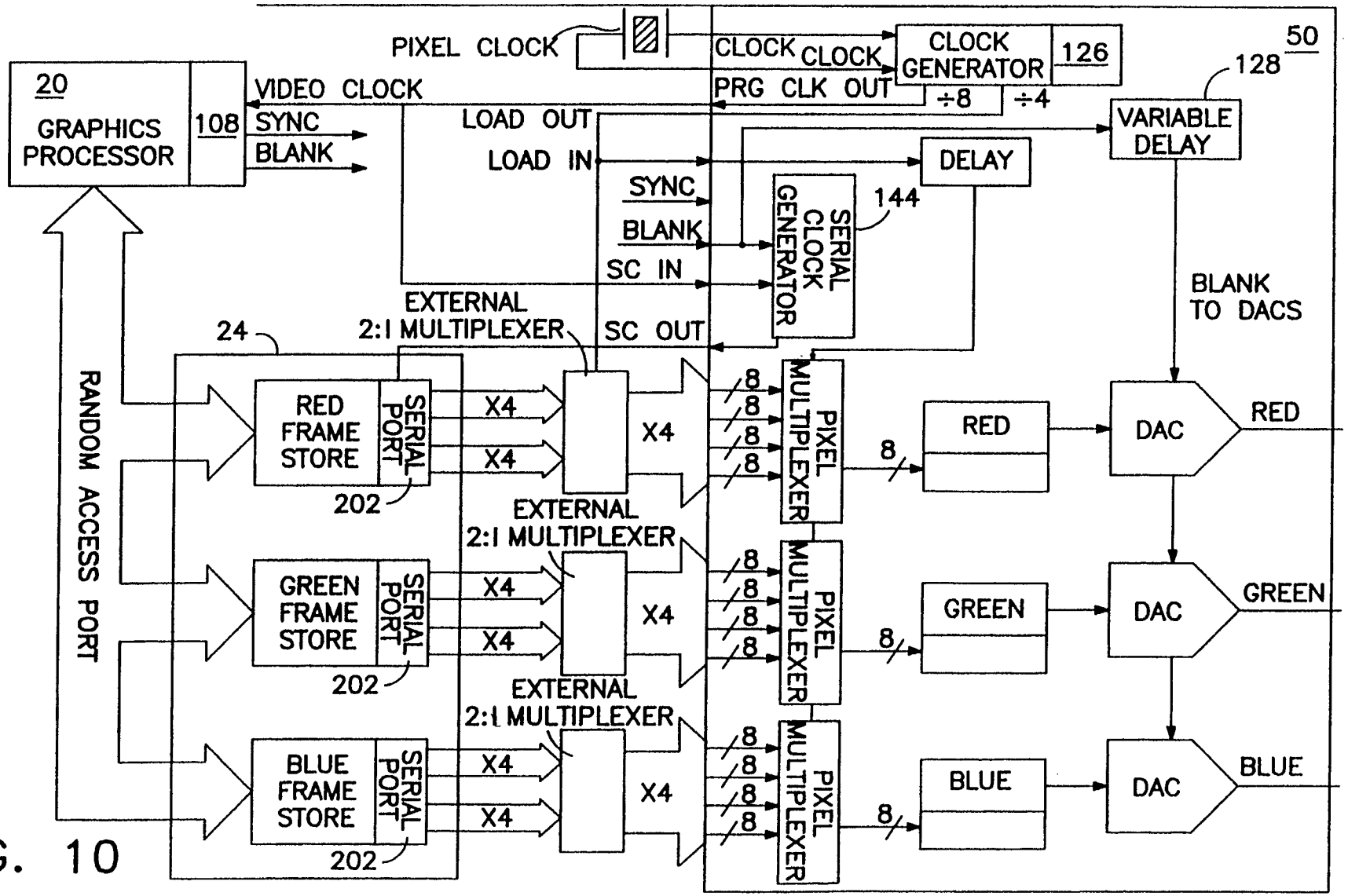
FIG. 10 is a block diagram similar to that of FIG. 1 but with a different system arrangement, to show how the novel IC chip in accordance with the invention readily accommodates different operational modes.

One of the important valuable features of the IC chip 50 is its adaptability to different operating modes or system arrangements. To illustrate that adaptability, FIG. 10 is included to show a system arrangement different from that of FIG. 1. The FIG. 10 system differs in that it includes an external device between the frame buffer 24 and the chip 50. In this case, the external device is an external 2:1 multiplexer 200. Such an additional multiplexer might be required if the frame buffer read-out port cannot supply pixel data to the 4:1 multiplexer 52 at the required rate.

In the system of FIG. 10, the serial read-out ports 202 of the frame buffer 24 are organized into 192 bit-planes, rather than 96 as in the FIG. 1 system. This provides for 8:1 pixel multiplexing (192 bits to 24 bits). The serial clock signal (SCOUT) however is derived from the PRGCLKOUT signal (connected to SCIN), in order to obtain a serial port clock signal which is divided-down 8:1 from the pixel clock. In contrast, in the FIG. 1 system, the SCOUT signal was derived from the 4:1 divided-down load-out signal at pin 132. The load-out signal cannot be connected to the SCIN pin in the FIG. 10 arrangement because the load out signal is not the correct frequency.

The programmable clock out signal (PRGCLKOUT) can be set to the required 8:1 ratio, using the programmable means 126 previously described, to produce the correct frequency for the SCIN signal (serial clock in). The SCIN signal is combined in the serial clock generator 144 with the Blank signal from the graphics processor 20 to generate the SCOUT signal during the periods of time when the CRT is to be painted. The SCOUT signal frequency provides for clocking the pixel data (now 8 pixels wide, parallel-format) from the buffer 24 to the 2:1 external multiplexer 200.

Figure 11:
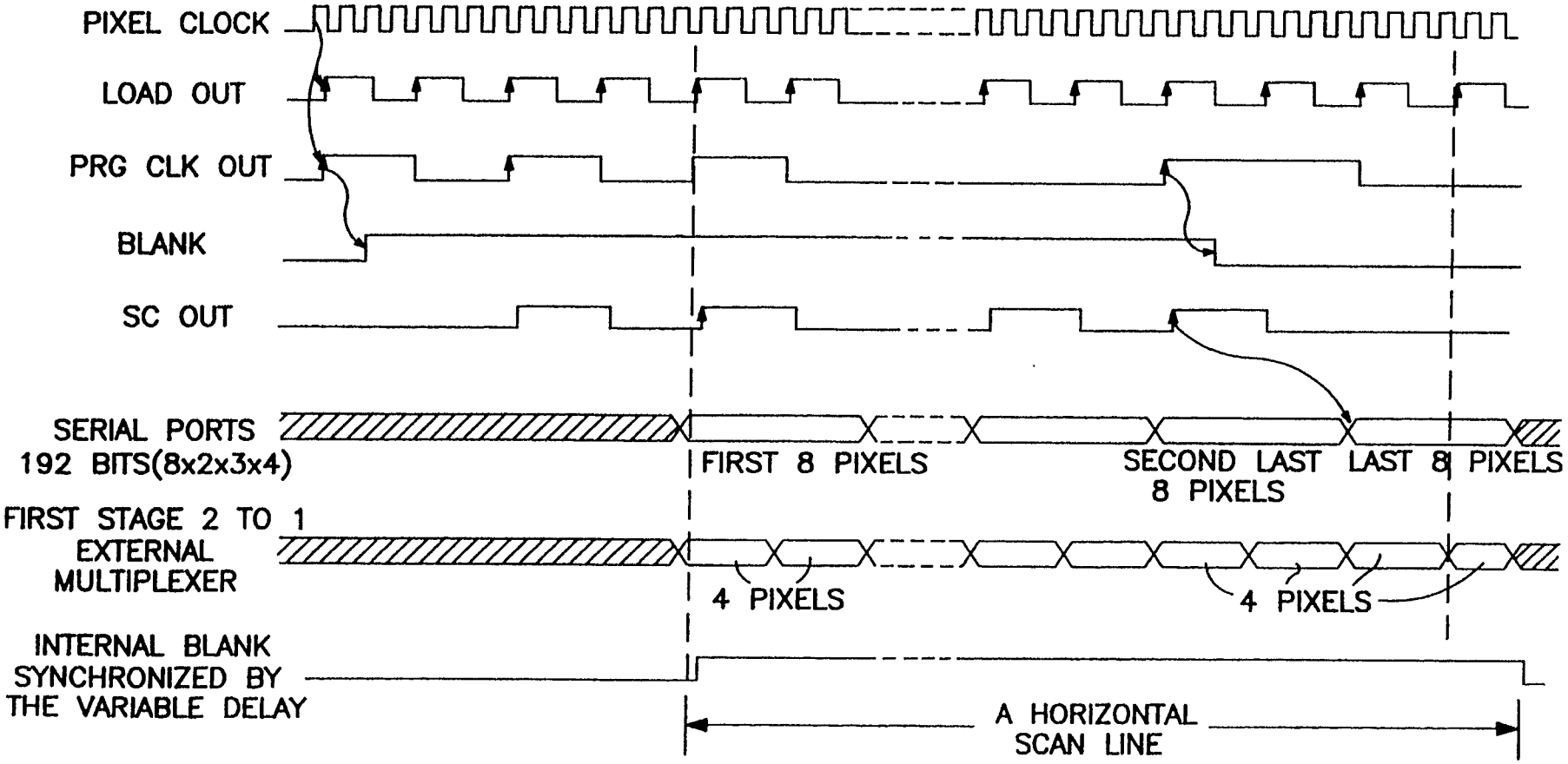
FIG. 11 is a timing diagram like FIG. 9, for use with FIG. 10.

The external multiplexer 200 accelerates the pixel data by a factor of two, into packets 4 pixels wide, as indicated on the timing diagram of FIG. 11. The load out signal (divided-down by 4:1) is connected by lead 206 to the external 2:1 multiplexer 200 to synchronize that multiplexer with the on-chip 4:1 multiplexer 52. The Blank signal from the graphics processor can be aligned properly with the pixel data by setting the variable delay 128 to the required time lag.

Although preferred embodiments of the invention have been disclosed herein in detail, it is to be understood that this is for the purpose of illustrating the invention, and should not be construed as necessarily limiting the scope of the invention since it is apparent that many changes can be made by those skilled in the art while still practicing the invention claimed herein.

What is claimed is:

1. For use in a control system for high-resolution CRT graphics display equipment of the type including a graphics processor and a frame buffer with serial port means from which digital pixel signals are serially clocked;

a single MOS integrated-circuit (IC) chip providing:

(a) clock generator means responsive to a clock signal source and having output means for producing corresponding clock signals;

(b) latch means to temporarily store digital signals received from said port means of said frame buffer;

(c) clock input means for said latch means to receive clock signals to synchronize the loading of data signals from said port means;

(d) means coupled to the output of said latch means to develop control signals for a CRT display device;

(e) serial clock generator means driven by said output of said clock generator means to produce a serial clock-out signal to be directed to said frame buffer to clock-out said digital pixel signals from said port means for transmission to said latch means; and (f) delay means coupled between said output of said clock generator and said clock input means of said latch means to deliver delayed clock signals from said clock generator, said delay means serving to delay the loading of said pixel signals from said frame buffer to an extent matching the inherent delay in said serial clock generator means in its production of clock pulses in response to clock signals from said clock generator means, thereby to assure proper read access cycle time at said latch means with corresponding high through-put rate from said frame buffer.

2. An IC chip as in claim 1, wherein said graphics processor includes means to produce CRT Synch signals; and means on said IC chip to receive said Synch signals for developing control signals for the CRT raster sweep circuitry.

3. Apparatus as in claim 1, wherein said control system includes at least one external signal processing device between said port means and said latch means; and means forming part of said IC chip to develop synchronizing signals for said external signal processing device.

4. Apparatus as in claims 3, wherein said external device is an external multiplexer.

5. In a control system for high-resolution CRT graphics display equipment of the type including a graphics processor and a frame buffer including video storage banks and port means from which digital pixel signals are serially clocked;

a single MOS integrated-circuit (IC) chip providing:

pixel receiving means to temporarily store digital signals developed by said port means of said frame buffer and including a clock input terminal;

clock generator means having first and second output means providing two output clock signals at different frequencies;

means coupling said first output means to said clock input terminal of said pixel receiving means to clock-in the pixel signals directed thereto;

a serial clock generator coupled to said second output means of said clock generator means and responsive to the clock signals of said second output means to produce corresponding serial clock signals for said port means to clock-out digital pixel signals therefrom;

said control system further including:

an external signal processing device coupled between said port means and said pixel receiving means and operable to receive said clocked-out digital pixel signals from said port means and to direct corresponding pixel signals to said pixel receiving means;

a synchronizing signal terminal at said external signal processing device to receive clock signals for synchronizing the development of pixel signals from said external processing device; and means for coupling said first output means of said clock generator means to said synchronizing signal terminal of said external signal processing device to provide clock signals thereto to effect synchronism between the pixel signals from said external signal processing device and the clocking of said pixel receiving means.

6. Apparatus as claimed in claim 5, wherein said chip further includes multiplexing means operable with said pixel receiving means and having an output for sequentially delivering digital data signals from said pixel receiving means for controlling the CRT display.

7. Apparatus as claimed in claim 5, wherein said external signal processing device is a multiplexer.

8. An IC chip as in claim 5, wherein said chip includes means developing an output of said clock generator means to provide a load-in signal to said pixel receiving means for loading digital pixel signals developed at the port means of said frame buffer, after processing by said external signal processing device, into said pixel receiving means.

9. An IC chip as in claim 5, including input means for said clock generator means; and means connected to said input means of said clock generator means for receiving pixel clock signals from an external source.

10. An IC chip as in claim 9, wherein said two outputs of said clock generator means provide divided-down signals derived from said pixel clock signals.

11. An IC chip as in claim 5, including delay means having an input and an output;

means coupling one of said clock generator means outputs to said delay means input; and means coupling said delay means output to said pixel receiving means.

12. For use in a control system for high-resolution CRT graphics display equipment of the type including a frame buffer and a graphics processor, wherein said frame buffer includes digital signal storage means and port means from which multi-bit digital data signals are serially clocked;

a single MOS integrated-circuit (IC) chip formed with a plurality of transistors and having connection pins to establish interconnection with said frame buffer and said graphics processor; said chip serving as the master timing control for the video signals of said system and incorporating:

(a) pixel receiving means to temporarily store digital data signals received from said port means of said frame buffer;

(b) a first pin to receive clock signals from an external high-frequency clock signal source;

(c) a clock generator within said chip having an input connected to said first pin to receive the external clock signals and having output means for producing corresponding clock signals to serve as video timing signals;

(d) a second pin coupled to said output means of said clock generator to provide a load-out signal; and (e) a third pin arranged to be alternatively connected to said second pin (1) directly, and (2) indirectly through an external device;

said third pin being connected to said pixel receiving means to provide a load-in signal serving to load digital data signals from said port means of said frame buffer into said pixel receiving means.

13. An IC chip as in claim 12, wherein said system includes an external multiplexer operable to receive digital data signals from said port means of said frame buffer and to direct corresponding signals to said pixel receiving means; and means on said chip to produce clock signals from said clock generator for synchronizing the operation of said external multiplexer.

14. An IC chip as in claim 13, including internal multiplexing means on said chip;

clock signals derived from said clock generator serving to synchronize both said external and said internal multiplexers.

15. An IC chip as in claim 12, including DAC means on said chip responsive to signals corresponding to the signals directed to said pixel receiving means and operable to develop analog intensity signals for the CRT display.

16. A single MOS integrated circuit (IC) for generating the analog control signals for a cathode ray tube (CRT) display, said IC including:

(a) a plurality of groups of input pins for receiving digital input signals representing the intensities of pixels to be displayed on the CRT;

(b) clock generator means receiving a pixel clock signal and producing a first output clock signal of frequency lower than the frequency of said pixel clock signal;

(c) a plurality of storage means respectively coupled to said groups of digital input pins and having output means for each storage means, said storage means including latch means with means receiving a first input clock signal which is lower in frequency than said pixel clock frequency by a ratio "n" where "n" is a positive integer;

(d) multiplexer means operable to accelerate the outputs of said plurality of storage means into single pixel streams, where the ratio of acceleration is the ratio "n";

(e) three digital-to-analog converters (DACs) responsive to said pixel streams respectively, said DACs generating said analog control signals for the Red, Green and Blue color guns respectively of the CRT display.

17. Apparatus as in claim 16 including means for delaying said first input clock signal prior to latching said storage means, said delay serving to synchronize the latching of said digital pixel inputs.

18. Apparatus as in claim 17 including means for arranging said first input clock signal alternatively to be received from (1) said first output clock signal, and (2) a component external to said IC.

19. Apparatus as in claim 16, wherein said clock generator means generates a second output clock signal also of frequency lower than the pixel clock frequency; and means arranged to provide for said first input clock signal alternatively to be received from (1) one of said first and second output clock signals, and (2) a component external to said IC.

20. Apparatus as in claim 19, including means to delay said first input clock signal prior to latching said storage means to provide for synchronizing the latching of said digital pixel inputs.

21. Apparatus as in claim 20, wherein one digital input to said IC is a blanking signal indicating that the CRT screen should be blanked, said IC further including:

(a) additional clock generator means responsive to one of said first and second output clock signals and said blanking signal for generating a serial shift clock output which can shift pixel values from external memory banks to said digital input pins of said IC, said shift clock starting and stopping in response to transitions of said blanking signal; and (b) variable delay means connected between said digital blanking input and blanking controls of said DACs, wherein said variable delay is adjustable to assure proper synchronism between the arrival of the digital pixel data and the un-blanking of the CRT.

22. Apparatus as in claim 21, wherein said variable delay includes both integer clock-period delays and delays which are less than a clock-period.

23. Apparatus as in claim 16, wherein said clock generator means generates a second output clock signal also of frequency lower than said pixel clock frequency;

said first and second output clock signals being different in frequency.

24. Apparatus as in claim 23, wherein said first and second output clock signals are divided down versions of said pixel clock signal.

25. Apparatus as in claim 23, wherein the first input clock signal means is connected to said first output clock signal, and said second output clock signal is of lower frequency than the first output clock signal to provide the second output clock signal be used to control the shifting of pixel data from external memory banks at a slower rate to the digital input pins of said IC.

26. The method of controlling a three-color CRT display by digital signals from a frame buffer to an IC chip including (a) three DACs for developing three analog signals for the CRT, (b) clock signal generator means, and (c) multiplexer means, said method comprising:

(1) developing from said clock signal generator means a first clock signal for said multiplexer means to provide for accelerating pixel signals sent out from said frame buffer to said chip;

(2) developing from said clock signal generator means a second clock signal having a frequency different from said first clock signal; and (3) applying said second clock signal to a pin of said IC to provide for activating an external data processing device which receives pixel signals from said frame buffer and processes the pixel signals prior to application to said IC where the pixel signals can be accelerated by said multiplexer means on said IC chip.

* * * * *